US010546709B2

(12) United States Patent
Abdala

(10) Patent No.: US 10,546,709 B2
(45) Date of Patent: Jan. 28, 2020

(54) EXTERNAL ROTARY OPERATING MECHANISM FOR A CIRCUIT BREAKER

(71) Applicant: WEG Drives and Controls Automação LTDA, Jaragua do Sul (BR)

(72) Inventor: João Paulo Abdala, Jaragua do Sul (BR)

(73) Assignee: WEG Drives and Controls Automação Ltda, Jaraguá do Sul-SC (BR)

( * ) Notice: Subject to any disclaimer, the term of this patent is extended or adjusted under 35 U.S.C. 154(b) by 0 days.

(21) Appl. No.: 16/140,848

(22) Filed: Sep. 25, 2018

(65) Prior Publication Data

US 2019/0198276 A1 Jun. 27, 2019

(30) Foreign Application Priority Data

Dec. 21, 2017 (BR) ..... 10 2017 027809

(51) Int. Cl.

| | |
|---|---|
| ***H01H 71/56*** | (2006.01) |
| ***H01H 69/00*** | (2006.01) |
| ***H01H 71/02*** | (2006.01) |
| ***H01H 71/10*** | (2006.01) |

(52) U.S. Cl.

CPC ..... *H01H 71/56* (2013.01); *H01H 69/00* (2013.01); *H01H 71/025* (2013.01); *H01H 71/1009* (2013.01); *H01H 2071/565* (2013.01); *H01H 2221/024* (2013.01); *H01H 2221/044* (2013.01); *H01H 2235/018* (2013.01)

(58) Field of Classification Search

CPC ..... H01H 71/56; H01H 2071/565; H01H 3/40

See application file for complete search history.

(56) References Cited

U.S. PATENT DOCUMENTS

| | | | | |
|---|---|---|---|---|
| 5,219,070 | A * | 6/1993 | Grunert | H01H 9/281 200/330 |
| 7,361,857 | B2 * | 4/2008 | Suh | H01H 3/08 200/330 |
| 9,337,629 | B2 * | 5/2016 | Oneufer | H02B 1/48 |
| 9,859,068 | B2 * | 1/2018 | Oneufer | H01H 71/56 |
| 10,361,053 | B2 * | 7/2019 | Roopnarine | H01H 69/00 |

FOREIGN PATENT DOCUMENTS

| | | |
|---|---|---|
| EP | 0522848 B1 | 1/1993 |
| GB | 1161310 A | 8/1969 |

* cited by examiner

*Primary Examiner* — Vanessa Girardi

(74) *Attorney, Agent, or Firm* — Troutman Sanders LLP; Ryan A. Schneider

(57) ABSTRACT

An engageable drive engageable operating mechanism for converting a movement of a linear translation operating handle to a rotating handle movement relative to the operative front face engageable with a molded-case circuit breaker. The mechanism includes an external rotating adapter external rotating operating member or alternatively an engageable drive engageable operating mechanism incorporating a handle assembly external rotating operating member, interchangeable with each other; and a gear, a support movable movement-converting support including a rack portion, and a structural support base, wherein the structural support base includes a built-in side opening chamber.

15 Claims, 11 Drawing Sheets

EXTERNAL ROTARY OPERATING MECHANISM FOR A CIRCUIT BREAKER

CROSS-REFERENCE TO RELATED APPLICATIONS

This application claims the benefit of BR Patent Application Serial No. 10 2017 027809-3 filed on 21 Dec. 2017, the benefit of the earlier filing date of which is hereby claimed under 35 USC § 119(a)-(d) and (f). The entire contents and substance of the application is hereby incorporated by reference.

BACKGROUND OF THE INVENTION

1. Field of the Invention

The present invention relates generally to electric protection switch operating mechanisms driven by a rotating component, and more particularly to an engageable operating mechanism for a molded-case circuit breaker used to facilitate manual operation of the operating handle in a low voltage molded-case circuit breaker, capable of providing front-side operation so that the molded-case circuit breaker can be operable before operation by means of a rotating handle or additionally using a power distribution cabinet door extender.

2. Description of Related Art

As it is known in the conventional state of the art, molded-case circuit breakers can be operated based on thermal, magnetic, thermomagnetic or even electronic principles. They can be used, above all for the protection of electric circuits subject to short circuits and/or electrical overloads generated by peaks of electric current that exceed a nominal limit previously established, through the movement of electric contacts.

Thus, circuit breakers fundamentally function in a manner analogous to electrical switches; that is, they function to change the electrical conduction state of an electric circuit between the "ON" and "OFF" states. In addition to automatically actuating, conventional circuit breakers also comprise a user-operated operating handle. Such operating handles can also be linked to engageable operating mechanisms in circuit breakers installed in enclosures of electrical distribution cabinets, which for safety reasons tend to be locked, which makes it difficult to directly access the molded-case circuit breaker handle and the place where it is desirable for the operating handle of the external operating mechanism of the molded case circuit breaker handle to be available on the external operating face thereof.

In the conventional state of the art most of these models and constructions of engageable operating mechanisms for circuit breakers fundamentally are based on the functional principle of mechanical cooperation between a pinion and a rack. Such a functional principle is broadly used in several fields of mechanics and widely known to those skilled in the art.

According to such functional principle, the pinion and the rack—physically coupled to one another—normally are disposed inside a protective enclosure coupled to the circuit breaker are associated with the operating handle of the circuit breaker. From this, there is a transmission of movements between these elements, and the rotating movement of the external rotating handle of the engageable operating mechanism, exerted manually by a user, triggers the rotating movement of the pinion and, consequently, the displacement in a linear trajectory of the rack, displacement such that acts directly on the operating handle of the molded-case circuit breaker, changing the operating position.

Some solutions containing an engageable operating mechanism for a molded-case circuit breaker have already been presented in the state of the art, such as GB1161310A, disclosing an extension set for the actuating lever of an electric circuit breaker, the unit comprising an element that defines a window configured to receive the actuating lever of a circuit breaker, having teeth meshed with a teethed sector, an operating handle mounted for rotation through an angle and an axis operatively engaged between the handle and the sector to transmit the rotation between each other so that when the set is fixed in relation to a circuit breaker with the actuating lever of the circuit breaker received by the window, the rotation of the lever and the movement of the actuating lever respectively cause the corresponding movement of the operating lever and the rotation of the lever.

Another solution is disclosed in U.S. Pat. No. 7,361,857B2, wherein an external handle operation mechanism for a molded circuit breaker comprising an external operating handle' a pinion gear coupled to the external operating handle to be rotatable, in response to a rotation of the external operating handle' a movable member having a rack portion coupled to the pinion gear to be moved linearly in accordance with the rotation of the pinion gear and provided with a connecting portion of the handle, connected to the handle of the molded circuit breaker to linearly move the handle of the molded circuit breaker and a plurality of support guides and guide rails in parallel with each other to guide the movable member to move linearly, wherein the movable member is assembled on the guide rail members through the support guides, so that it is easy to control a necessary course for a displacement of the molded circuit-breaker handle and the displacement of the external operating handle, according to the course, and being able to transfer energy accurately and efficiently when performing a "RESET" operation.

Another solution is disclosed in EP0522848B1, wherein a rotating motion transfer device of a rotating handle is attached to a linear lever movement of an "ON/OFF" device, having a support and attachment base in the circuit breaker.

The prior art have by means of the construction of an accessory engaged to a molded-case circuit breaker, a transmission means between the rotating handle and the linear translation handle of the molded-case circuit breaker, wherein the transmission of the movement is made by means of a pinion and rack mechanism, wherein the assembly is made integrally from the upper or lower side, providing for the use of screws to hold the components fixed, in particular in the internal region, so as allow the movement therebetween of the main internal rotating and sliding components.

BRIEF SUMMARY OF THE INVENTION

As an example, there are several means developed to assist the control of switching devices, in order to provide an engageable operating mechanism for operation of a molded-case circuit breaker, which is efficient in converting a linear translational handle movement to a rotating handle movement relative to the front operating face, in order to reduce the acting forces by the operator; however, the constant search for improvement motivated the evolution and some unresolved problems in the state of the art.

Briefly described, in a preferred form, the present invention comprises an engageable drive engageable operating mechanism for converting a movement of a linear translation operating handle to a rotating handle movement relative to the operative front face engageable with a molded-case circuit breaker. The mechanism includes an external rotating adapter external rotating operating member or alternatively an engageable drive engageable operating mechanism incorporating a handle assembly external rotating operating member, interchangeable with each other; and a gear, a support movable movement-converting support including a rack portion, and a structural support base, wherein the structural support base includes a built-in side opening chamber.

In an exemplary embodiment, the present invention comprises an operating mechanism for a molded-case circuit breaker having an operating handle comprising an external rotating operating member having first and second radially opposing flaps, a support base, and an engageable cross-shaped cavity, a gear having teeth, a cross-shaped latch, a passing hole, and a ring, wherein the gear being locked and secured to the center of the external rotating operating member, a movable movement-converting support having a rack portion having teeth, a through hole, and an adaptation cavity, wherein the rack portion is coupled to the gear, a structural support base having a side chamber, and first and second passage recesses, wherein as a result of a rotational operating movement of the external rotating operating member, the movable movement-converting support slides linearly in a path analogous to the operating handle of the molded-case circuit breaker, through the adaptation cavity, and wherein the side chamber incorporates a side opening for the introduction of the movable movement-converting support.

The gear can be positioned on the movable movement-converting support such that a longitudinal center line T of the cross-shaped latch of the gear is tilted with respect to a longitudinal center line S of the rack portion of the movable movement-converting support.

The gear can be positioned between the teeth of the rack portion of the movable movement-converting support so as to allow concentricity between the through hole of the movable movement-converting support with the passing hole of the gear.

The movable movement-converting support and the gear can be inserted into the side chamber of the structural support base until the ring of the gear is concentric with the through hole of the structural support base.

The external rotating operating member can be inserted into the structural support base through an upper part of the external operating mechanism, from the coincidence of the first and second radially opposing flaps of the external rotating operating member in the first and second passage recesses of the structural support base until the support base of the external rotating operating member engages a support ring of the support base.

The engageable cross-shaped cavity of the external rotating operating member can be configured coincident with the cross-shaped latch of the gear, such that assembled together, they provide a mechanical movement engagement between the external rotating operating member and the gear.

The operating mechanism can further comprise a first fixing member, wherein the first fixing member is set in the passing hole of the gear, which passes through the through hole of the movable movement-converting support, both preposed in the side chamber of the structural support base to be fixed next to the passing hole of the gear.

In another exemplary embodiment, the present invention comprises an operating mechanism for a molded-case circuit breaker having an operating handle comprising an external rotating operating member having a center, a gear being locked and secured to the center of the external rotating operating member, a movable movement-converting support comprising a rack portion coupled to the gear, and an adaptation cavity, a structural support base comprising a side chamber, wherein as a result of a rotational operating movement of the external rotating operating member, the movable movement-converting support slides linearly in a path analogous to the operating handle of the molded-case circuit breaker, through the adaptation cavity, and wherein the side chamber incorporates a side opening for the introduction of the movable movement-converting support.

The movable movement-converting support can be assembled in the side chamber guided by incorporated sliding rails of the structural support base.

The side chamber of the structural support base can comprise a sliding channel and sliding rails, wherein movable movement-converting support can further comprise a linear lower sliding guide and a linear upper sliding guide, wherein the gear and the movable movement-converting support are insertable into the side chamber of the structural support base, guided by the cooperation of the sliding channel and sliding rails with the linear lower sliding guide and the linear upper sliding guide.

The operating mechanism can further comprise a first fixing member, wherein the movable movement-converting support further comprises a through hole, wherein the gear comprises a passing hole, and wherein the first fixing member passes through the through hole of the movable movement-converting support and fixed adjacent to the passing hole of the gear.

The external rotating operating member can further comprises first and second radially opposing flaps, wherein the structural support base further comprises first and second passage recesses, and wherein an assembly between the external rotating operating member and the structural support base is possible when the first and second radially opposing flaps are coincident with the first and second passage recesses.

The components of the external rotating operating member can comprise an external rotating grip handle, an engagement cavity, a direct manual-activating operating button, a positioning rod, a locking pin, a locking engagement, and a spring, wherein upon assembly of the components of the external rotating operating member, the components are locked together by locking engagement and the engagement cavity, keeping the spring imprisoned and guided by the locking pin to perform a return function of the direct manual-activating operating button to an initial resting position.

The movable movement-converting support can further comprise a return spring and a seat for the return spring, wherein the structural support base further comprises a support face, and wherein the return spring is located between the seat and the support face.

In another exemplary embodiment, the present invention comprises a method of assembling an external operating mechanism for a molded-case circuit breaker comprising prepositioning a gear having teeth on a movable movement-converting support such that a longitudinal center line T of a cross-shaped latch of the gear is tilted with respect to a longitudinal center line S of a rack portion having teeth of the movable movement-converting support, so that the gear with teeth is positioned between the teeth of the rack portion of the movable movement-converting support so as to allow concentricity between a through hole of the movable movement-converting support with a passing hole of the gear, inserting the movable movement-converting support and the gear into a side chamber of a structural support base until a ring of the gear is concentric with a through hole of the structural support base, inserting an external rotating operating member into the structural support base through an upper part of the external operating mechanism, from the coincidence of first and second radially opposing flaps of the external rotating operating member in first and second passage recesses of the structural support base until a support base of the external rotating operating member engages a support ring of the support base, where the external rotating operating member is previously inserted so that an engageable cross-shaped cavity of the external rotating operating member is configured coincident with the cross-shaped latch of the gear, assembled together, to provide a mechanical movement engagement between the external rotating operating member and the gear, and setting a first fixing member in the passing hole of the gear, which passes through the through hole of the movable movement-converting support, both preposed in the side chamber of the structural support base to be fixed next to the passing hole of the gear.

An object of the invention is to provide a switch device with fewer components than the state of the art.

Another object of the invention is to provide a preparation in order to facilitate the final assembly process of a rotating handle mechanism for operation of a molded-case circuit breaker.

Another object of the invention is to enable the total assembly of the device in a stable manner for storage and handling.

Another object of the invention is to provide a set meeting the above requirements, being compact and simplified.

These and other objects, features and advantages of the present invention will become more apparent upon reading the following specification in conjunction with the accompanying drawing figures.

DETAIL DESCRIPTION OF THE INVENTION

Figure 1:
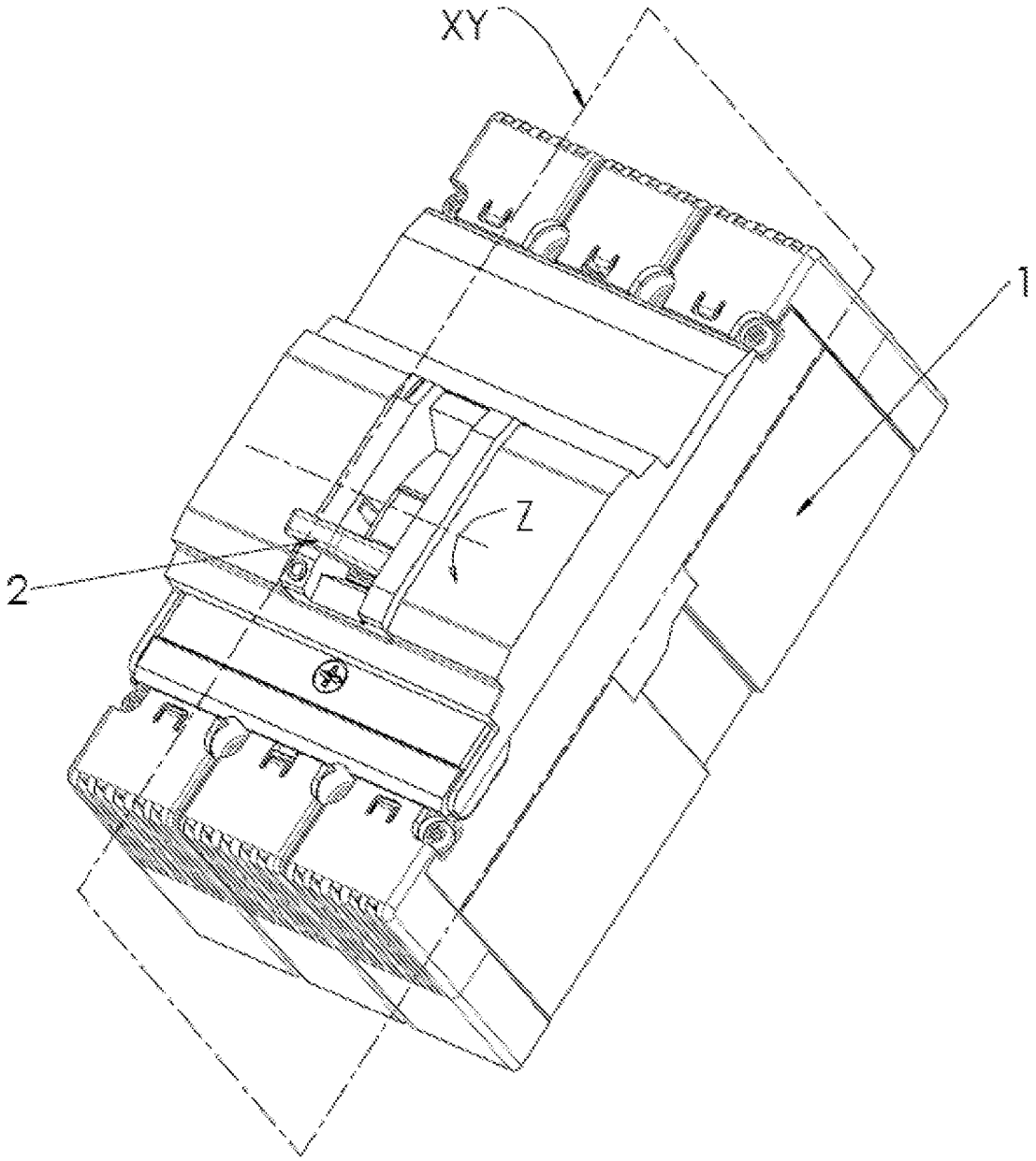
FIG. 1 shows, in an isometric perspective view, a molded-case circuit breaker and its operating handle, according to an exemplary embodiment of the present invention.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

As used herein, the present invention has internal components (not viewable to a user of the invention unless the invention is dissembled), and components that include at least a portion that are viewable by the user of the assembled invention. Sometimes herein components will be described as being internal, or at an internal side, or being of an internal portion of the invention, or other like descriptions to mean those above-defined internal components. Sometimes herein components will be described as being external, or at an external side, or being of an external portion of the invention, or other like descriptions to mean those above-defined external components.

Figure 2:
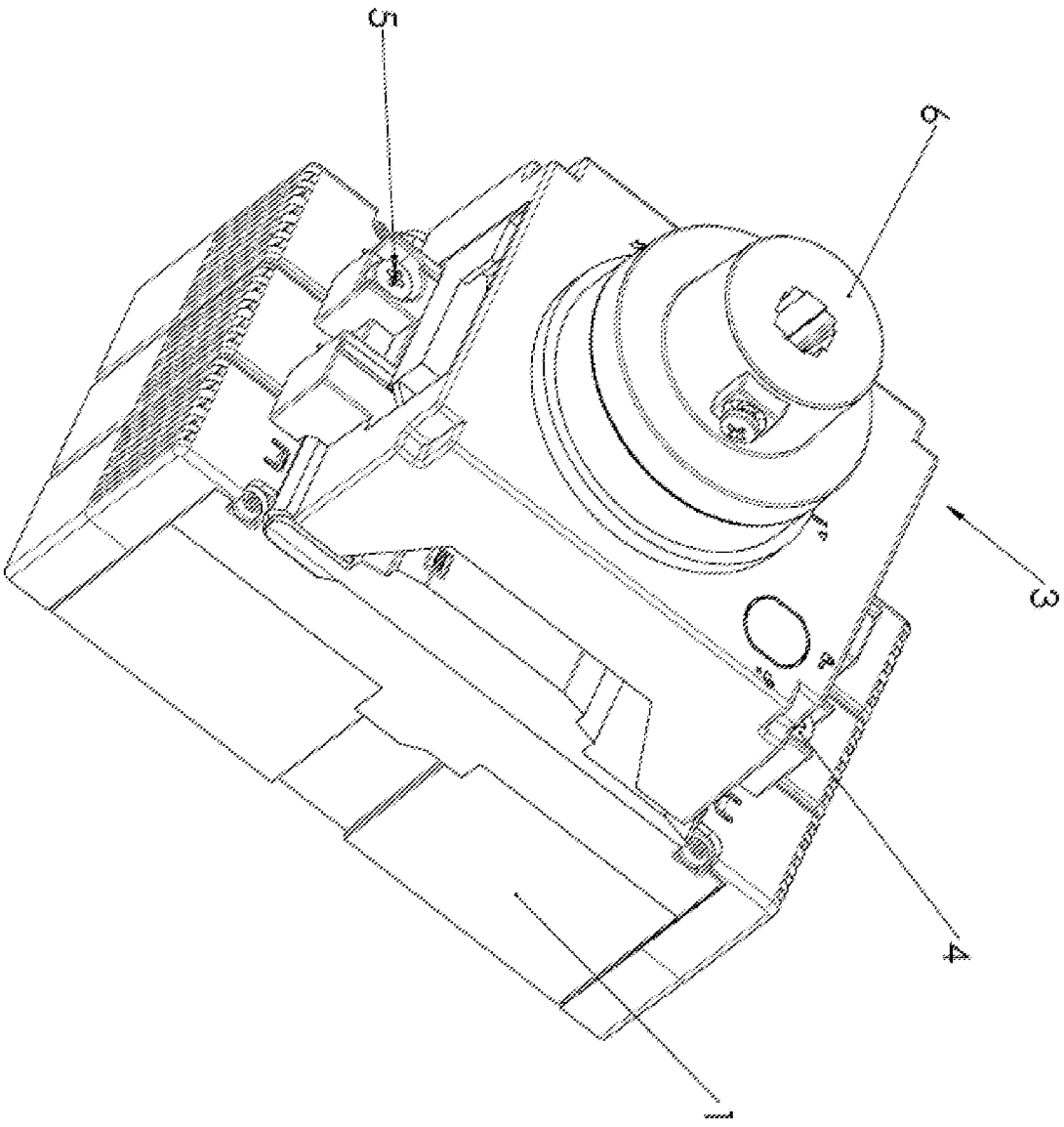
FIG. 2 shows, in an isometric perspective view, an engageable operating mechanism for circuit breakers, according to an exemplary embodiment of the invention, engaged to the molded-case circuit breaker of FIG. 1, according to an exemplary embodiment of the present invention.

FIGS. 1 and 2 show, in an isometric view, a state of the art molded-case circuit breaker 1, the type comprising at least one operating handle 2, positioned centrally and frontally to the molded-case circuit breaker 1, aligned to an "XY" plane, an operating handle 2 of the molded-case circuit breaker 1 being passive to a translational movement in relation to the front operating face and the "XY" plane and internally in rotating trajectory, in a schematic pivot axis "Z".

Figure 3A:
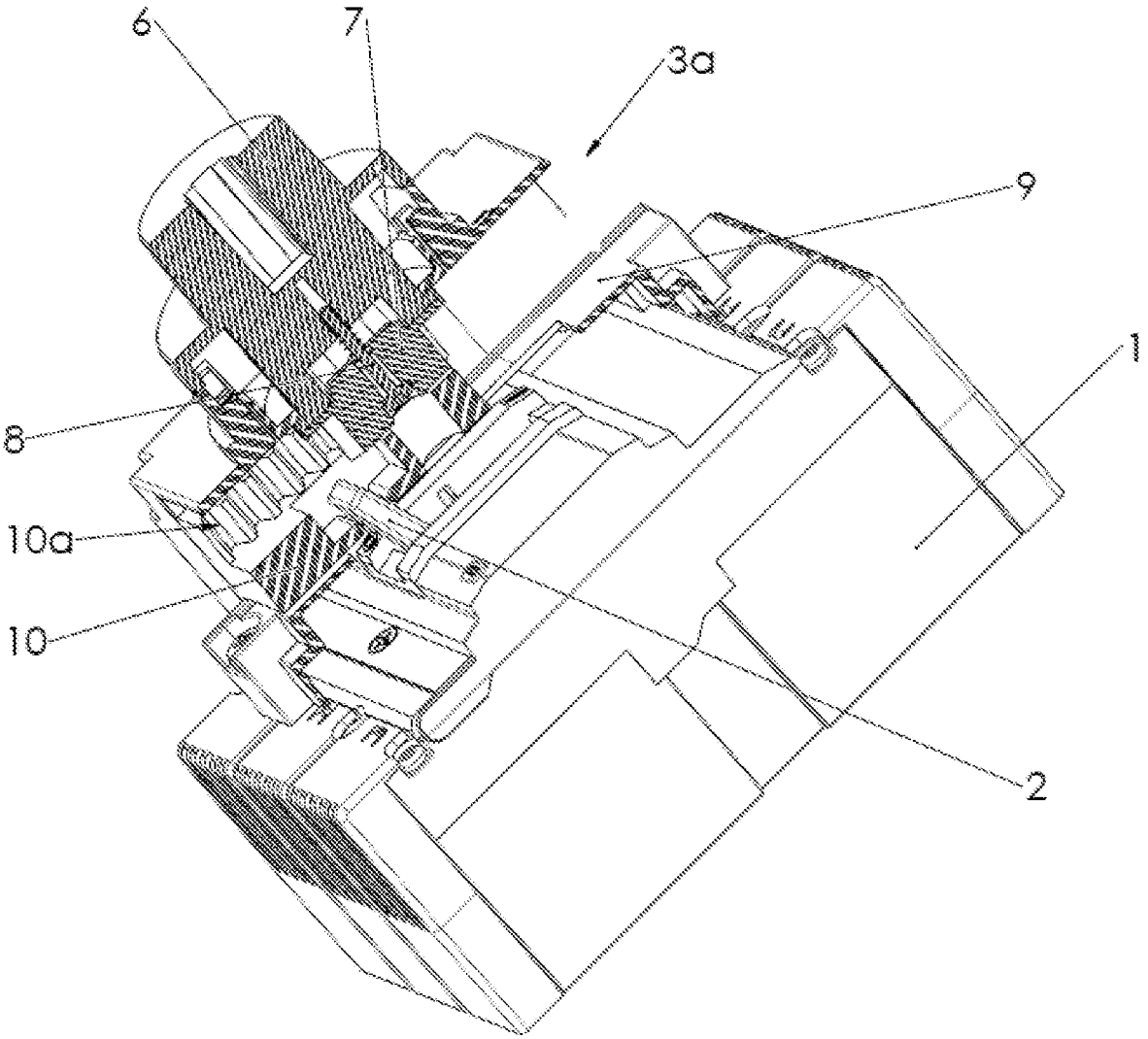
FIG. 3A shows, in a partial cross-section perspective view, an engageable operating mechanism for circuit breakers, according to an exemplary embodiment of the invention, engaged to the molded-case circuit breaker of FIG. 1 in the "OFF" position, according to an exemplary embodiment of the present invention.

FIG. 3A shows, in an isometric perspective view, a side cross-sectional section of the engageable operating mechanism 3*a* assembled to the molded-case circuit breaker 1 shown in FIG. 1, comprising an external rotating operating member 6, a first fixing member 8 for a gear 7 fixed to the center of the external rotating operating member 6, a structural support base 9, a movable movement-converting support 10, comprising a rack portion 10*a* among other components, wherein the movable movement-converting support 10 is seen to be recessed together with the operating handle 2 of the molded-case circuit breaker 1 in the "OFF" position, according to an exemplary embodiment of the invention.

Figure 3B:
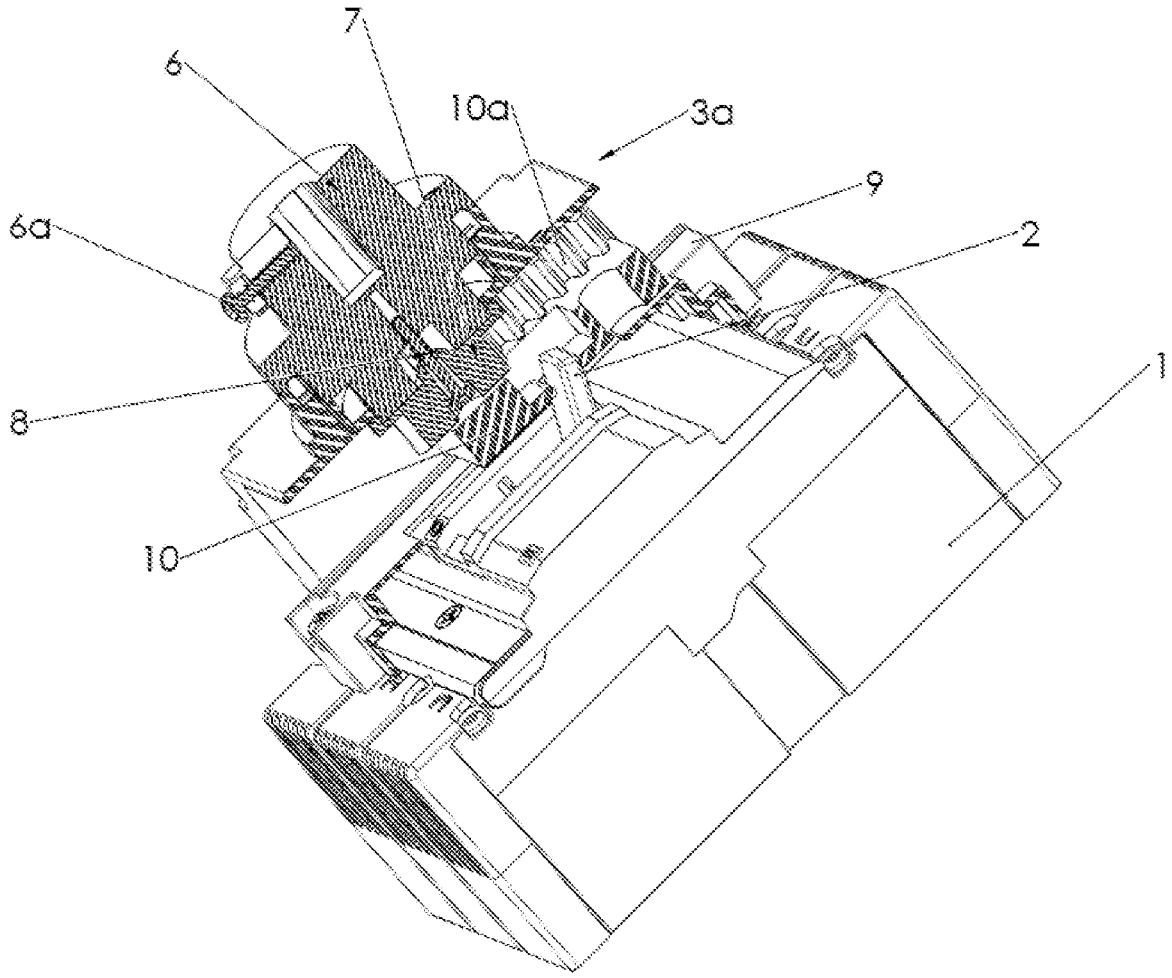
FIG. 3B shows, in a partial cross-section perspective view, the engageable operating mechanism for circuit breakers, according to an exemplary embodiment of the invention, engaged to the circuit breaker shown in FIG. 1 in the "ON" position, according to an exemplary embodiment of the present invention.

FIG. 3B shows, in an isometric perspective view, a side cross-sectional section of the engageable operating mechanism 3*a* assembled to the molded-case circuit breaker 1 shown in FIG. 1, comprising the external rotating operating member 6, a second fixing member 6*a*, the first fixing member 8 for the gear 7, fixed to the center of the external rotating operating member 6, the structural support base 9, the movable movement-converting support 10 comprising the rack portion 10*a* between other components, wherein the movable movement-converting support 10 is seen to be advanced, together with the operating handle 2 of the molded-case circuit breaker 1 in the "ON" position, according to an exemplary embodiment of the invention.

Figure 4:
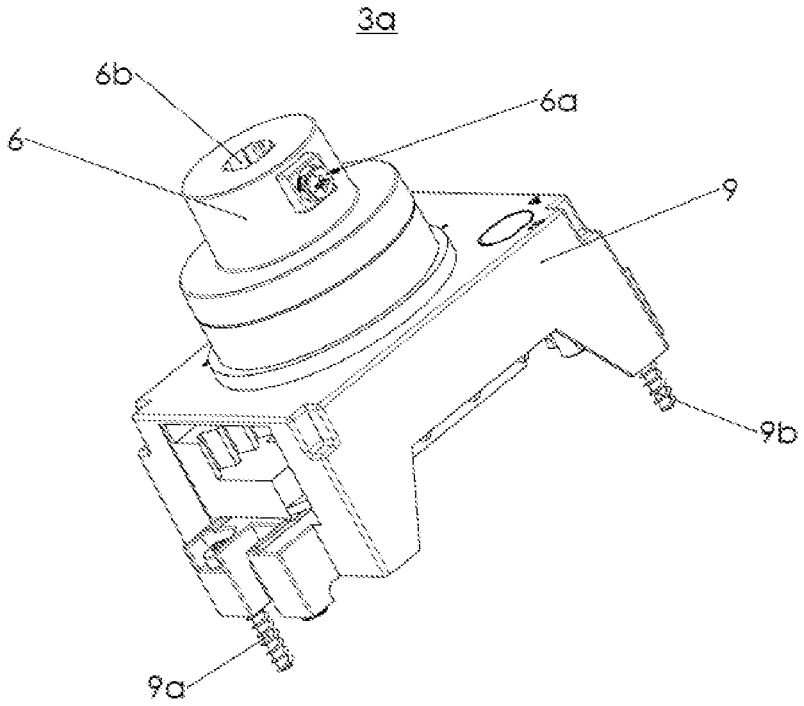
FIG. 4 shows, in an upper perspective view, the engageable operating mechanism for circuit breakers, according to an exemplary embodiment of the invention, in the "OFF" position, according to an exemplary embodiment of the present invention.

FIG. 4 shows, in an upper isometric perspective view, the engageable operating mechanism 3*a*, comprising the structural support base 9, the external rotating operating member 6, comprising the second fixing member 6*a* controlled by an electric protection and control cabinet door rod (not shown), and first and second fixing elements 9*a*, 9*b*, wherein the rod (not shown) can be positioned and fixed in a hole 6*b*, through the second fixing member 6*a*, according to an exemplary embodiment of the invention.

Figure 5:
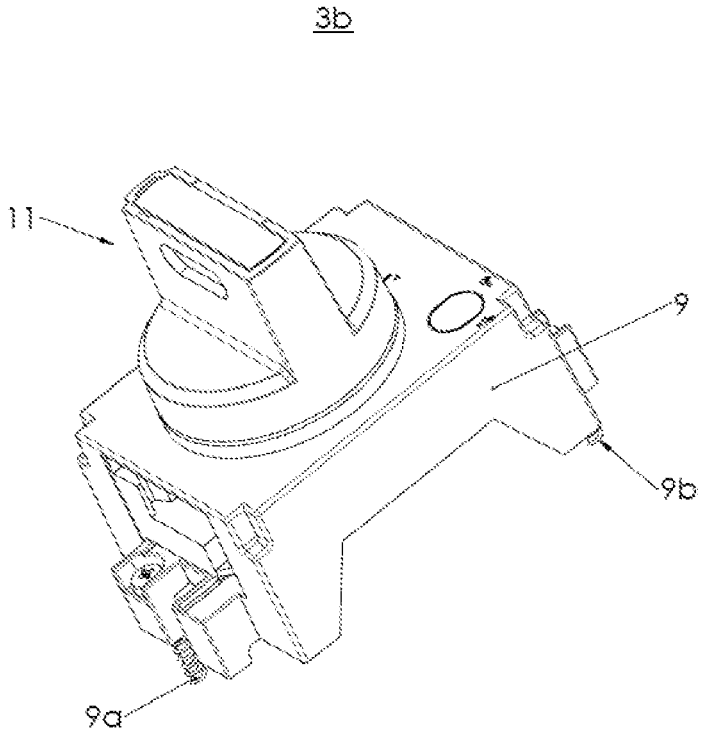
FIG. 5 shows, in an upper perspective view, the engageable operating mechanism for circuit breakers, according to an exemplary embodiment of the invention, in the "OFF" position, according to an exemplary embodiment of the present invention.

FIG. 5 shows, in an upper isometric view, an engageable operating mechanism 3*b*, comprising an external rotating operating member 11, a structural support base 9, and first and second fixing elements 9*a*, 9*b* according to an exemplary embodiment of the invention.

Figure 6A:
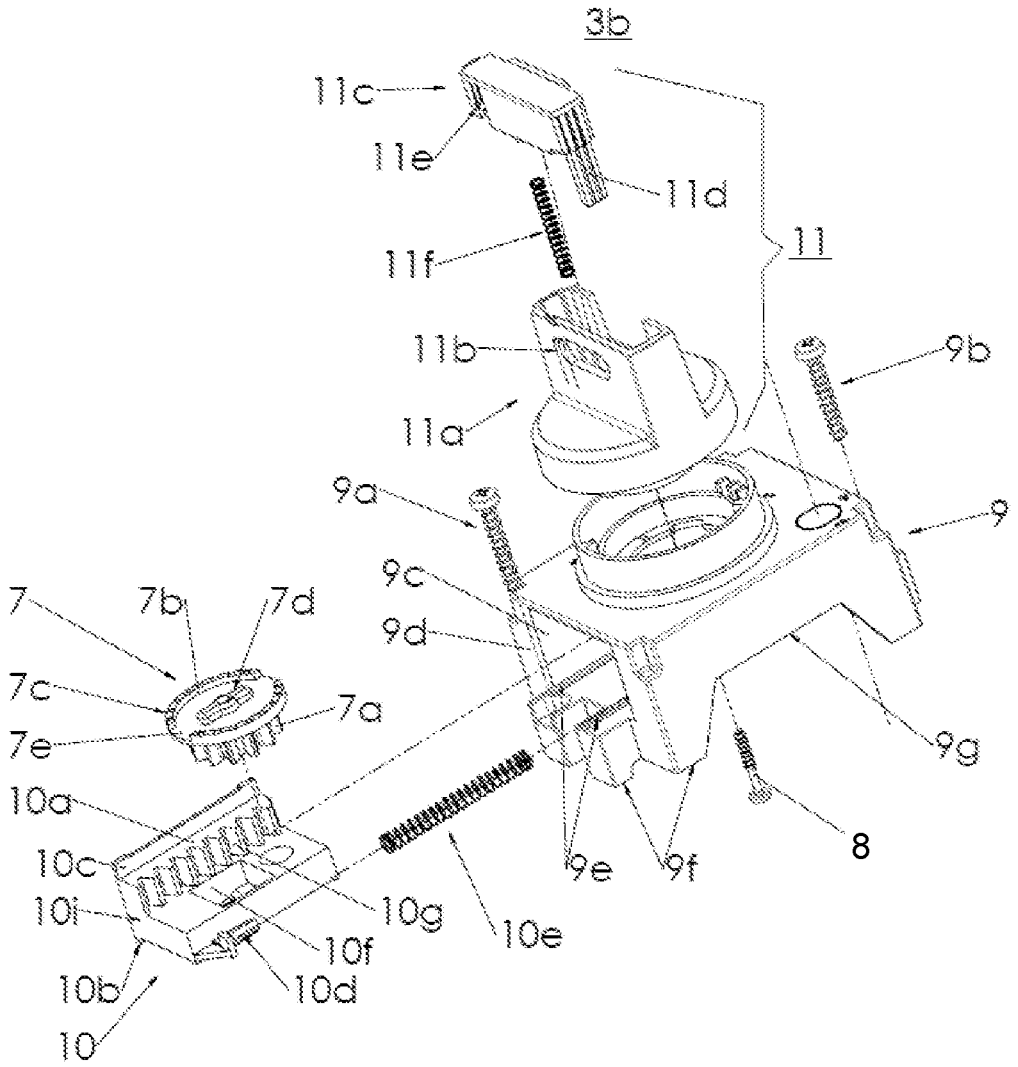
FIG. 6A shows, in an exploded upper perspective view, the engageable operating mechanism for circuit breakers, according to an exemplary embodiment of the invention, in the "OFF" position, according to an exemplary embodiment of the present invention.

FIG. 6A shows, in an exploded upper perspective view, the engageable operating mechanism 3*b* comprising in the upper part of the assembly the external rotating operating member 11, an external rotating grip handle 11*a*, an engagement cavity 11*b*, a direct manual-activating operating button 11*c*, a positioning rod 11*d*, a locking engagement 11*e* and a spring 11*f*.

The engageable operating mechanism 3*b* further comprises the assembly side of the gear 7 comprising teeth 7*a*, a ring 7*b*, a first set of recesses 7*c* of the ring, a cross-shaped latch 7*d*, second set of recesses 7*e*.

The engageable operating mechanism 3*b* further comprises the movable movement-converting support 10 provided with the built-in rack portion 10*a* comprising teeth 10*g*, a lateral face 10*i*, a linear lower sliding guide 10*b*, a linear upper sliding guide 10*c*, a seat 10*d* for a return spring 10*e*, an adaptation cavity 10*f* for the operating handle 2 of the molded-case circuit breaker 1, as seen in FIG. 1.

Figure 9A:
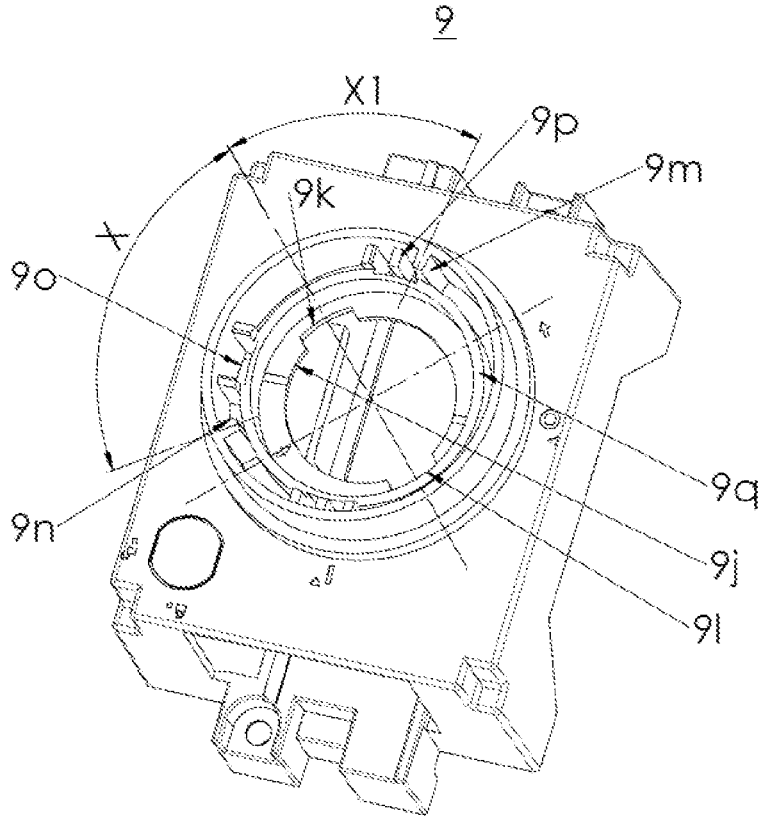
FIG. 9A shows, in an upper perspective view, the structural support base of the engageable operating mechanism for circuit breakers, according to an exemplary embodiment of the present invention.
Figure 9B:
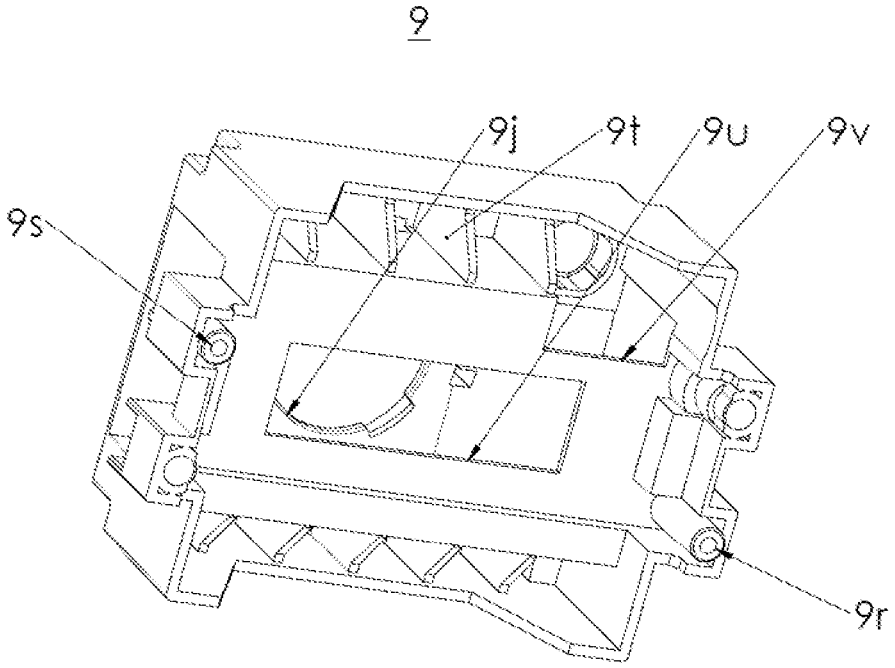
FIG. 9B shows, in a bottom perspective view, the structural support base of the engageable operating mechanism for circuit breakers, according to an exemplary embodiment of the present invention.

The engageable operating mechanism 3*b* further comprises in the lower part the structural support base 9 comprising a side chamber 9*d*, side faces 9*c*, sliding rails 9*e*, lower bearing faces 9*f*, side reliefs 9*g*, and first and second fixing elements 9*a*, 9*b*, the structural support base 9 seen in greater details in FIGS. 9A and 9B, and a first fixing member 8 for a gear 7, the engageable operating mechanism 3*b* engageable in position "OFF" according to an exemplary embodiment of the invention.

Figure 6B:
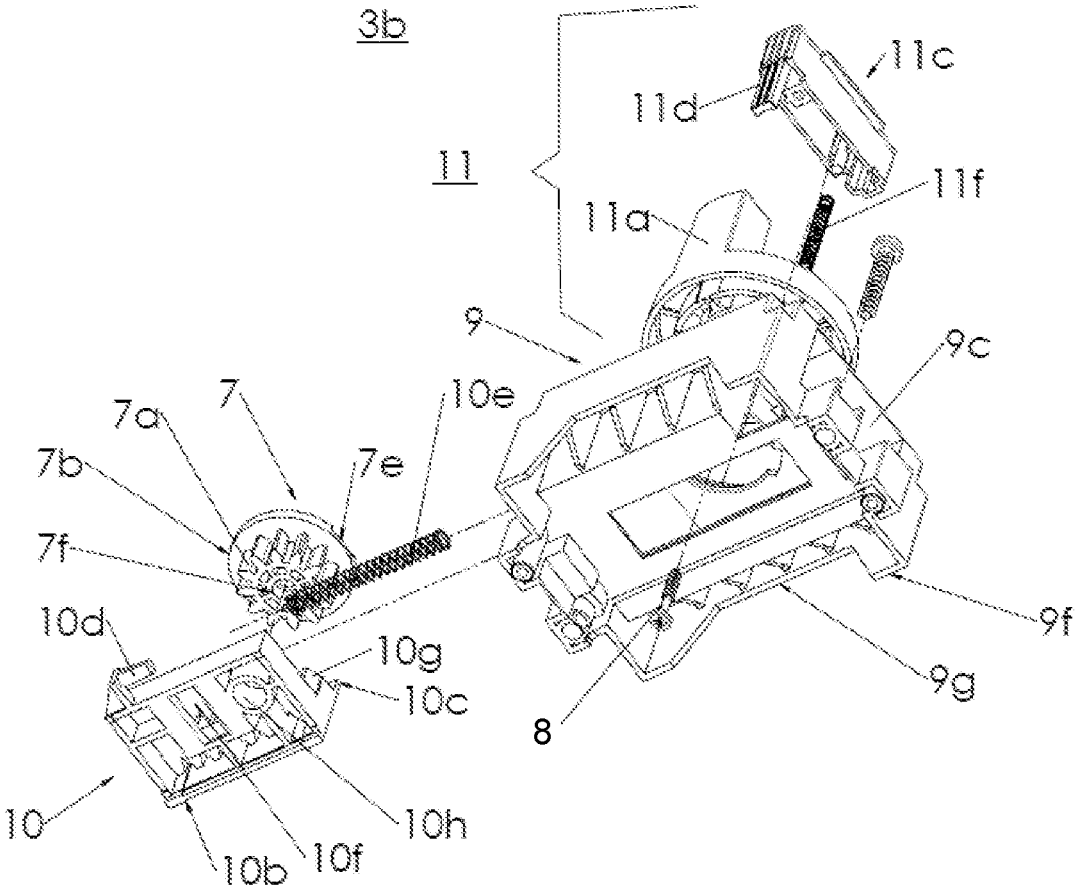
FIG. 6B shows, in an exploded bottom perspective view, the engageable operating mechanism for circuit breakers, according to an exemplary embodiment of the invention, in the "OFF" position, according to an exemplary embodiment of the present invention.

FIG. 6B shows, in an exploded bottom perspective view, the engageable operating mechanism 3*b* comprising in the upper assembly part the external rotating operating member 11 comprising the external rotating grip handle 11*a*, an engagement cavity 11*b* as seen in FIG. 6A, the direct manual-activating operating button 11*c*, the positioning rod 11*d*, the locking engagement 11*e* as seen in FIG. 6A, a guide pin 11*m* and the spring 11*f*.

The assembly side part of the engageable operating mechanism 3*b* includes the gear 7 comprising teeth 7*a*, ring 7*b*, a passing hole 7*f*. It further includes the movable movement-converting support 10 comprising the rack portion 10*a*, best visible in its extension in FIG. 6A, teeth 10*g*, the linear lower sliding guide 10*b*, the linear upper sliding guide 10*c*, the seat 10*d* for the return spring 10*e*, the adaptation cavity 10*f* for the operating handle 2 of the molded-case circuit breaker 1 seen in FIG. 1, a through hole 10*h*, and the return spring 10*e*.

The assembly side part of the engageable operating mechanism 3*b* further includes in the lower part the structural support base 9 comprising the side chamber 9*c*, a support face 9*x*, lower bearing faces 9*f* and the side reliefs 9*g*, the structural support base 9, seen in more details in FIGS. 9A and 9B, and the first fixing member 8 for the gear 7 in the "OFF" position, according to an exemplary embodiment of the invention.

Figure 7:
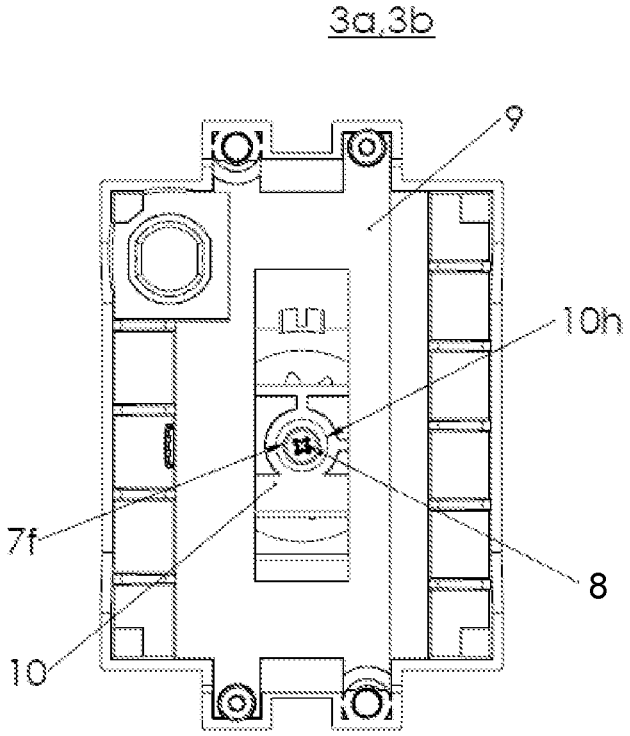
FIG. 7 shows, in a bottom front view, a structural support base of the engageable operating mechanism for circuit breakers, among other components, according to an exemplary embodiment of the present invention.

FIG. 7 shows, in a bottom front view, the engageable operating mechanisms 3*a*, 3*b*, comprising the structural support base 9 in a position allowing the access of the first fixing member 8 in the passing hole 7*f* of the gear 7 as seen in FIG. 6B through the hole 10*h* of the movable movement-converting support 10 according to an exemplary embodiment of the invention.

Figure 8:
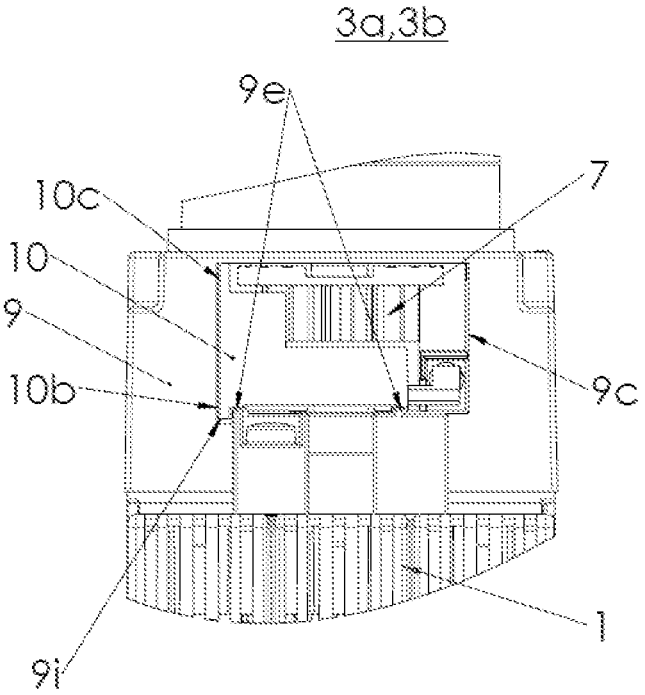
FIG. 8 shows, in a front side view, the structural support base of the engageable operating mechanism for circuit breakers, engaged to the circuit breaker, according to an exemplary embodiment of the present invention.

FIG. 8 shows, in a front side view, the structural support base 9 of the engageable operating mechanisms 3*a*, 3*b* assembled on the molded-case circuit breaker 1 seen in FIG. 1 comprising a side chamber 9*c*, a sliding channel 9*i* and sliding rails 9*e*, where the gear 7 and the movable movement-converting support 10 are inserted, the linear lower sliding guide 10*b*, and the linear upper sliding guide 10*c*, according to an exemplary embodiment of the invention.

FIG. 9A is a upper perspective view of the structural support base 9 comprising a through hole 9*j*, first and second passage recesses 9*k*, 9*l*, first and second rotating limiting members 9*m*, 9*n*, a positioning seat 9*o* and another positioning ribbed seat 9*p* in addition to a support ring 9*q*, wherein a preferred angle (α) between the second rotating limiting member 9*n* and the first passage recess 9*k* is less than 90° and a preferred angle (β) between the positioning ribbed seat 9*p* and the first passage recess 9*k* is less than 90°, and wherein the first passage recess 9*k* has a different dimension from the second passage recess 9*l* according to an exemplary embodiment of the invention.

FIG. 9B is a bottom perspective view of the structural support base 9 comprising the through hole 9*j*, in addition to first and second fixing holes 9*r*, 9*s* of the structural support base 9 to the molded-case circuit breaker 1, as shown in FIG. 1, through first and second fixing elements 9*a*, 9*b*, seen in FIGS. 3A, 4, 5 and 6A, reinforcing grooves 9*t*, a window 9*u* and a cutout 9*v* according to an exemplary embodiment of the invention.

Figure 10:
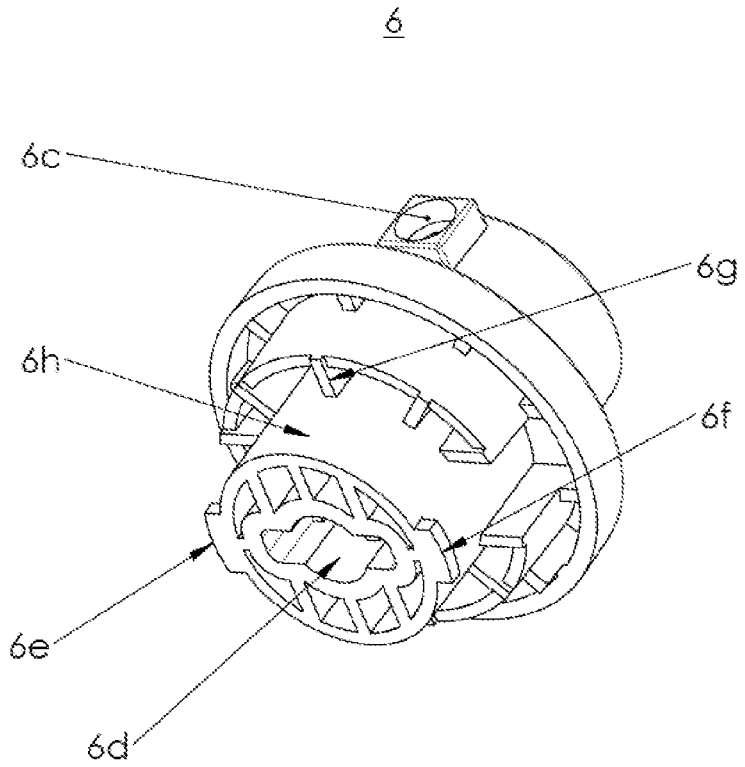
FIG. 10 shows, in a bottom perspective view, a one-rod adapter of the engageable operating mechanism for circuit breakers, according to an exemplary embodiment of the present invention.

FIG. 10 is a bottom perspective view of the external rotating operating member 6 comprising a hole 6*c* for positioning the second fixing member 6*a*, seen in FIGS. 3A and 4, for rod fixing (not shown), an engageable cross-shaped cavity 6*d*, first and second radially opposing flaps 6*e*, 6*f*, a support base 6*g* projecting from a cylindrical ring 6*h* forming part of the structure of the external rotating operating member 6 and where the first radially opposing flap 6*e* is larger than the second radially opposing flap 6*f*, or alternatively the second radially opposing flap 6*f* is larger than the first radially opposing flap 6*e* so as to be different from each other according to an exemplary embodiment of the invention.

Figure 11:
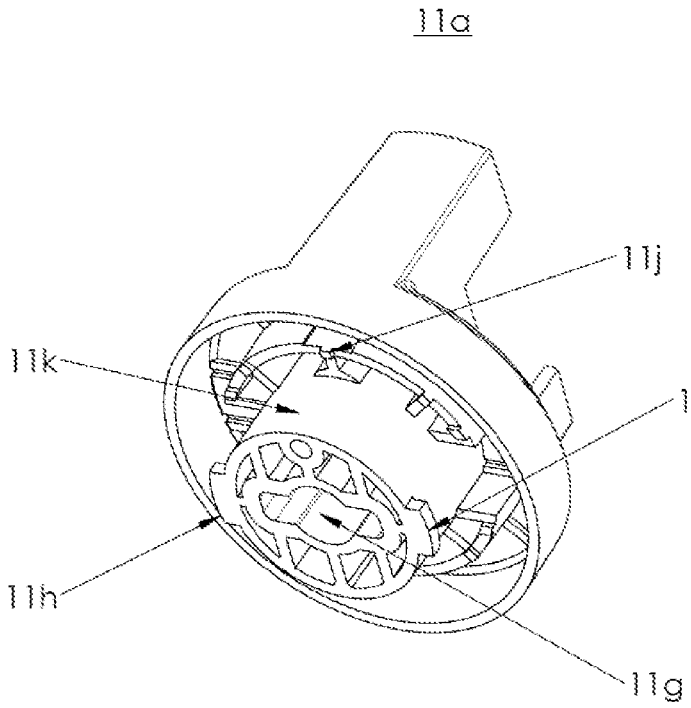
FIG. 11 shows, in a bottom perspective view, a grip handle of the engageable operating mechanism for circuit breakers, according to an exemplary embodiment of the present invention.

FIG. 11 is a bottom front view of the external rotating grip handle 11*a* comprising an engageable cross-shaped cavity 11*g*, third and fourth radially opposing flaps 11*h*, 11*i*, a support base 11*j* projecting from a ring 11*k*, which is part of the structure of the external rotating grip handle 11*a*, and wherein the third radially opposing flap 11*h* is larger than the fourth radially opposing flap 11*i*, or alternatively the fourth radially opposing flap 11*i* is larger than the third radially opposing flap 11*h*, so that they are different with each other, according to an exemplary embodiment of the invention.

Figure 12:
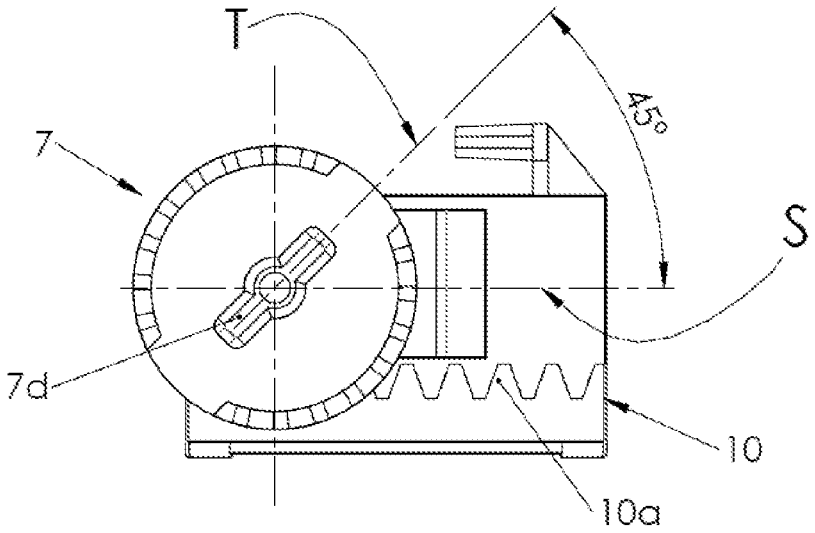
FIG. 12 shows, in a front upper view, a pre-assembly of a gear in the movable support, according to an exemplary embodiment of the present invention.

FIG. 12 shows, in a front upper view, a pre-assembly of the gear 7 in the movable movement-converting support 10, wherein the longitudinal center line T of the cross-shaped latch 7*d* is seen tilted in 45° in relation to the center line S of the rack portion 10*a* of the movable movement-converting support 10.

Figure 13:
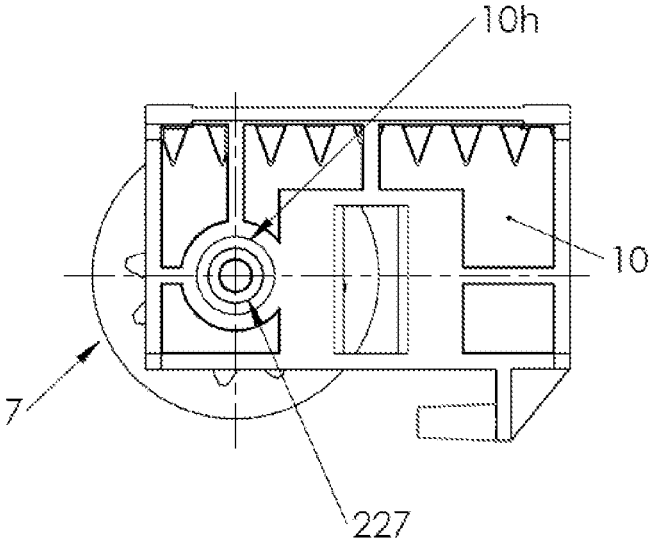
FIG. 13 shows, in a front bottom view, a pre-assembly of the gear in the movable support, according to an exemplary embodiment of the present invention.

FIG. 13 shows, in a front bottom view, the pre-assembly of the gear 7 in the movable movement-converting support 10, wherein the through hole 10*h* of the movable movement-converting support 10 is positioned aligned with the passing hole 7*f* of the gear 7, as seen in FIG. 6B.

The engageable operating mechanisms 3*a*, 3*b*, fulfill an object of the invention in converting the movement of an operating handle 2 of a moldable molded-case circuit breaker 1, the operating handle 2 being subject to a translational movement in relation to the operating front face in the plan XY, and in internally rotating trajectory on a rotating schematic axis "Z" to a rotating movement of the external rotating operating member 6 of the engageable operating mechanism 3*a*, or alternatively of the external rotating operating member 11 of the engageable operating mechanism 3*b* with respect to the operating front face of the circuit breaker by means of the first and second fixing elements 9*a*, 9*b* through the first and second fixing holes 9*r*, 9*s* of the structural support base 9, in at least two exemplary embodiments, with fewer components and solving other problems reported in relation to the state of the art.

In an exemplary embodiment, the engageable operating mechanism 3*a* comprises the external rotating operating member 6 for a rod (not shown), which communicates to a port and to the exterior of the electric control and protection cabinet by another device operating handle 2 suitable of the prior art (not shown), the bearing gear 7 secured to the center of the external rotating operating member 6, the movable movement-converting support 10 comprising the rack portion 10*a* coupled to the gear 7, the structural support base 9 comprising the side chamber 9*c*, wherein, as a result of the rotational operation movement of the external rotating operating member 6, the movable movement-converting support 10 slides linearly in a path analogous to the operating handle 2 of the molded-case circuit breaker 1 through the adaptation cavity 10*f* to convert a linear translation movement of the operating handle 2 of the molded-case circuit breaker 1, which is moldable for a rotational movement of the external rotating operating member 6 relative to the front operating face, in which the side chamber 9*c* coupled to the structural support base 9 comprises a side opening for the introduction of the movable movement-converting support 10, having as main functions, "ON", "OFF", "LOCK" "TRIP" and "RESET".

In another exemplary embodiment, the engageable operating mechanism 3*b* comprises the direct external manual-activating rotating operating member 11 and the bearing gear 7 secured to the center of the external rotating operating member 11, the movable movement-converting support 10 comprising the rack portion 10*a* incorporated, coupled to the gear 7, the structural support base 9 comprising the side chamber 9*c*, wherein, as a result of the rotational operating movement of the external rotating operating member 11, the movable movement-converting support 10 slides linearly in a path analogous to an operating handle 2 of the molded-case circuit breaker 1, through the adaptation cavity 10*f* for converting a linear translation movement of the operating handle 2 of the molding-case circuit breaker 1 for a rotational movement of the external rotating operating member 11 relative to the front operating face, in which the side chamber 9*c* incorporated to the structural support base 9 comprises a side opening for the introduction of the movable movement-converting support 10, having as main functions, "ON", "OFF", "LOCK", "TRIP" and "RESET".

The engageable operating mechanisms 3*a*, 3*b* comprise commonly in their construction the gear 7, the first fixing member 8 for the gear 7, first and second fixing elements 9*a*, 9*b* for the structural support base 9, the support movable movement-converting support 10, the return spring 10*e*, wherein the structural support base 9 comprises a side opening of the side chamber 9*c* incorporated to the structural support base 9, allowing configuration flexibility in a first embodiment, being controllable by means of the external rotating operating member 6 of the engageable operating mechanism 3*a*, or in at least an exemplary embodiment using the external rotating operating member 11 of the engageable operating mechanism 3*b*.

On the side opening, the movable movement-converting support 10 is assembled in the side chamber 9*c*, being preferably guided by the sliding rails 9*e* incorporated from the structural support base 9 by means of the linear lower sliding guide 10*b*, in the sliding channel 9*i*, and the linear upper sliding guide 10*c*, being possible to obtain directly by molding or by layer printing.

The engageable operating mechanism 3*b*, being the external rotating operation member 11 comprises the external rotating grip handle 11*a*, the engaging cavity 11*b*, the direct manual-activating operating button 11*c*, the positioning rod 11*d*, the locking engagement 11*e* and the spring 11*f*, which after assembled are locked together by the engagement locking engagement 11*e* and the engagement cavity 11*b*, keeping the spring 11*f* imprisoned and guided by the guide pin 11*m* to perform a return function of the direct manual-activating operating button 11*c* to an initial resting position.

The present invention also relates to a method of assembling the engageable operating mechanism 3*a*, 3*b* comprising a number of sequential assembly steps:

1. Prepositioning the gear 7 on the movable motion conversion support movable movement-converting support 10, such that the longitudinal center line T of a cross-shaped latch 7*d* is preferably tilted at 45° with respect to the longitudinal center line S of the rack portion 10*a* of the movable movement-converting support 10, so that the gear 7 with teeth 7*a* is positioned between the teeth 10*g* of the rack portion 10*a* of the movable movement-converting support 10 so as to allow concentricity between the through hole 10*h* of the movable movement-converting support 10 with the passing hole 7*f* of the gear 7.

2. Insert the movable movement-converting support 10 and the gear 7 preposed into the opening of the side chamber 9*c* in the manner quoted above in step 1 until the ring 7*b* of the gear 7 is concentric with the through hole 9*j* of the structural support base 9 of support.

3. Insert the external rotating operating member 6, 11 into the structural support base 9 through the upper part, from the coincidence of the flaps 6*e*, 6*f*; 11*h*, 11*i* in the recesses 9*l*; 9*k*; 9*k*; and 9*l* of the structural support base 9 until the support base 6*g* of the external rotating operating member 6 touches the support ring 9*q* of the structural support base 9, where the external rotating operating member 6 is previously inserted so that the engageable cross-shaped cavity 6*d* is configured coincident with the cross-shaped latch 7*d* of the gear 7, assembled together, to provide the mechanical movement engagement between the external rotating operating member 6 and the gear 7.

4. Set the first fixing member 8 in the passing hole 7*f* of the gear 7 which passes through the through hole 10*h* of the movable movement-converting support 10, both preposed in the side chamber 9*c* to be fixed next to a passing hole 7*f* of the gear 7.

The process, additional object that the invention presents, is advantageous in that the engageable operating mechanisms 3*a*, 3*b* after execution of the assembly steps can be handled freely, without the possibility of loss of parts or the need to be assembled completely on the molded-case circuit breaker 1; thus solving many problems of the state of the art such as to enable a preparation for the final assembly process of the engageable operating mechanisms 3*a*, 3*b* to a molded-case circuit breaker 1, stable for storage and handling, the assembly having a smaller number of components, being compact and simplified when compared to the state of the art, also in that it has an assembly that allows at least two embodiments of the engageable operating mechanisms 3*a*, 3*b* using the external rotating operating member 6 for coupling a rod (not shown), or the engageable operating mechanisms 3*b*.

Numerous characteristics and advantages have been set forth in the foregoing description, together with details of structure and function. While the invention has been disclosed in several forms, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

What is claimed is:

1. An operating mechanism for a molded-case circuit breaker having an operating handle comprising:

an external rotating operating member having first and second radially opposing flaps, a support base, and an engageable cross-shaped cavity a gear having teeth, a cross-shaped latch, a passing hole, and a ring, wherein the gear being locked and secured to the center of the external rotating operating member;

a movable movement-converting support having a rack portion having teeth, a through hole, and an adaptation cavity, wherein the rack portion is coupled to the gear;

a structural support base having a side chamber, and first and second passage recesses;

wherein as a result of a rotational operating movement of the external rotating operating member, the movable movement-converting support slides linearly in a path analogous to the operating handle of the molded-case circuit breaker, through the adaptation cavity; and wherein the side chamber incorporates a side opening for the introduction of the movable movement-converting support.

2. The operating mechanism of claim 1, wherein the movable movement-converting support and the gear are inserted into the side chamber of the structural support base until the ring of the gear is concentric with the through hole of the structural support base.

3. The operating mechanism of claim 1 further comprising a first fixing member, wherein the first fixing member is set in the passing hole of the gear, which passes through the through hole of the movable movement-converting support, both proposed in the side chamber of the structural support base to be fixed next to the passing hole of the gear.

4. The operating mechanism of claim 1, wherein the gear is positioned on the movable movement-converting support such that a longitudinal center line T of the cross-shaped latch of the gear is tilted with respect to a longitudinal center line S of the rack portion of the movable movement-converting support.

5. The operating mechanism of claim 4, wherein the gear is positioned between the teeth of the rack portion of the movable movement-converting support so as to allow concentricity between the through hole of the movable movement-converting support with the passing hole of the gear.

6. The operating mechanism of claim 1, wherein the external rotating operating member is inserted into the structural support base through an upper part of the external operating mechanism, from the coincidence of the first and second radially opposing flaps of the external rotating operating member in the first and second passage recesses of the structural support base until the support base of the external rotating operating member engages a support ring of the support base.

7. The operating mechanism of claim 6, wherein the engageable cross-shaped cavity of the external rotating operating member is configured coincident with the cross-shaped latch of the gear, such that assembled together, they provide a mechanical movement engagement between the external rotating operating member and the gear.

8. An operating mechanism for a molded-case circuit breaker having an operating handle comprising:

an external rotating operating member having a center;

a gear being locked and secured to the center of the external rotating operating member;

a movable movement-converting support comprising:

a rack portion coupled to the gear; and an adaptation cavity;

a structural support base comprising a side chamber;

wherein as a result of a rotational operating movement of the external rotating operating member, the movable movement-converting support slides linearly in a path analogous to the operating handle of the molded-case circuit breaker, through the adaptation cavity; and wherein the side chamber incorporates a side opening for the introduction of the movable movement-converting support.

9. The operating mechanism of claim 8, wherein the movable movement-converting support is assembled in the side chamber guided by incorporated sliding rails of the structural support base.

10. The operating mechanism of claim 8, wherein the side chamber of the structural support base comprises:

a sliding channel; and sliding rails;

wherein movable movement-converting support further comprises:

a linear lower sliding guide; and a linear upper sliding guide;

wherein the gear and the movable movement-converting support are insertable into the side chamber of the structural support base, guided by the cooperation of the sliding channel and sliding rails with the linear lower sliding guide and the linear upper sliding guide.

11. The operating mechanism of claim 8 further comprising a first fixing member;

wherein the movable movement-converting support further comprises a through hole;

wherein the gear comprises a passing hole; and wherein the first fixing member passes through the through hole of the movable movement-converting support and fixed adjacent to the passing hole of the gear.

12. The operating mechanism of claim 8, wherein the external rotating operating member comprises first and second radially opposing flaps;

wherein the structural support base further comprises first and second passage recesses; and wherein an assembly between the external rotating operating member and the structural support base is possible when the first and second radially opposing flaps are coincident with the first and second passage recesses.

13. The operating mechanism of claim 8, wherein components of the external rotating operating member comprise:

an external rotating grip handle;

an engagement cavity;

a direct manual-activating operating button;

a positioning rod;

a locking pin;

a locking engagement; and a spring;

wherein upon assembly of the components of the external rotating operating member, the components are locked together by locking engagement and the engagement cavity, keeping the spring imprisoned and guided by the locking pin to perform a return function of the direct manual-activating operating button to an initial resting position.

14. The operating mechanism of claim 8, wherein the movable movement-converting support further comprises a return spring and a seat for the return spring;

wherein the structural support base further comprises a support face; and wherein the return spring is located between the seat and the support face.

15. A method of assembling an external operating mechanism for a molded-case circuit breaker comprising:

prepositioning a gear having teeth on a movable movement-converting support such that a longitudinal center line T of a cross-shaped latch of the gear is tilted with respect to a longitudinal center line S of a rack portion having teeth of the movable movement-converting support, so that the gear with teeth is positioned between the teeth of the rack portion of the movable movement-converting support so as to allow concentricity between a through hole of the movable movement-converting support with a passing hole of the gear;

inserting the movable movement-converting support and the gear into a side chamber of a structural support base until a ring of the gear is concentric with a through hole of the structural support base;

inserting an external rotating operating member into the structural support base, from the coincidence of first and second radially opposing flaps of the external rotating operating member in first and second passage recesses of the structural support base until a support base of the external rotating operating member engages a support ring of the support base, where the external rotating operating member is previously inserted so that an engageable cross-shaped cavity of the external rotating operating member is configured coincident with the cross-shaped latch of the gear, assembled together, to provide a mechanical movement engagement between the external rotating operating member and the gear; and setting a first fixing member in the passing hole of the gear, which passes through the through hole of the movable movement-converting support, both preposed in the side chamber of the structural support base to be fixed next to the passing hole of the gear.

* * * * *